US005485731A

United States Patent [19]

Venetucci et al.

[11] Patent Number: 5,485,731

[45] Date of Patent: Jan. 23, 1996

[54] PROTECTION FOR MOTORS IN REFRIGERATED ENVIRONMENTS

[75] Inventors: Jim M. Venetucci, Forest Park, Ill.; Horst Spaeth, Rogers, Ark.

[73] Assignee: Liquid Carbonic Corporation, Oak Brook, Ill.

[21] Appl. No.: 271,165

[22] Filed: Jul. 6, 1994

[51] Int. Cl.[6] ..... F25D 17/00

[52] U.S. Cl. ..... 62/56; 62/259.2; 62/505; 62/384; 62/378; 310/59

[58] Field of Search ..... 62/56, 62, 63, 62/64, 259.2, 373, 374, 378, 379, 384, 381, 388, 505; 310/52, 58, 59

[56] References Cited

U.S. PATENT DOCUMENTS

| | | | |
|---|---|---|---|
| 4,344,291 | 8/1982 | Tyree, Jr. et al. | 62/62 |
| 4,356,707 | 11/1982 | Tyree, Jr. et al. | 62/381 |
| 4,745,314 | 5/1988 | Nakano | 310/59 |
| 5,205,135 | 4/1993 | Lang | 62/381 |
| 5,270,596 | 12/1993 | Shibuya et al. | 310/40 |

FOREIGN PATENT DOCUMENTS

| | | | |
|---|---|---|---|
| 52-61703 | 5/1977 | Japan | H02K 9/26 |
| 1170-557-A | 7/1985 | U.S.S.R. | H02K 9/26 |
| 1309-188-A | 5/1987 | U.S.S.R. | H02K 9/20 |
| 1319-172-A | 6/1987 | U.S.S.R. | H02K 9/19 |

*Primary Examiner*—John M. Sollecito
*Attorney, Agent, or Firm*—Fitch, Even, Tabin & Flannery

[57] ABSTRACT

A protection system for electric motors in refrigerated environments, especially those environments cooled to very low temperatures, includes routing a cryogen coolant through the electric motor. A minimum flow of cryogen coolant is maintained through the motor to prevent ingress of moisture in the motor interior. The arrangement is especially useful with cryogenically cooled refrigeration systems, because the same cryogen coolant used to refrigerate the system can also be used to provide a purging flow of cryogen coolant gas through the electric motor.

21 Claims, 8 Drawing Sheets

PROTECTION FOR MOTORS IN REFRIGERATED ENVIRONMENTS

BACKGROUND OF THE INVENTION

1. Field of the Invention

The present invention pertains to electric motors in refrigerated environments, and in particular to the protection of such motors against moisture intrusion.

2. Description of the Related Art

Electric motors are operated in a wide variety of environments, including those maintained at temperatures below that of ambient. For example, in the food preparation industry, freezers of different configurations have been employed to cool and freeze food products carried on conveyor belts through a refrigerated environment. Fans driven by electric motors are typically provided in such equipment to increase heat transfer rates, thereby reducing the residence time required for products in the freezers. As will be appreciated by those skilled in the art, foodstuffs impart heat and moisture loadings to the refrigerated environment. Oftentimes, attempts are made to control the freezer operation so as to adequately accommodate the heat loadings required for a particular commercial application, while moisture loadings and the consequence of moisture entrainment in the refrigerated environment has been tolerated with little or no control.

SUMMARY OF THE INVENTION

Moisture loadings in a freezer apparatus and the deleterious effects of moisture loadings on refrigeration equipment have been closely studied. For example, attention has been directed to fans driven by electric motors located within the freezer environment. These types of fans are contrasted with overhead fans (typically employed in tunnel freezers), having fan blades located within the freezer environment, driven by motors located outside of the freezer cabinet, in ambient surroundings. It has been observed that electric motors located within freezer environments experience more rapid rates of deterioration of both electrical and mechanical components of the motor. Investigation has revealed that moisture introduced into the freezer environment tends to accumulate within the electric motors at surprisingly rapid rates of accumulation. The formation of ice and frost within the electric motors caused by moisture entrainment is believed to result in accelerated stress on the motor windings (an electrical phenomenon) and accelerated wear on the bearings and other moving parts of the motor (a mechanical phenomenon).

Electric motors are sometimes classified as having "open frame" or "closed frame" (or "sealed") configurations, with the latter typically being employed in so-called "explosion proof" applications. Performance of electric motors, even of the closed frame type within a tunnel freezer environment, is not comparable to life expectancy and other performance considerations associated with electric motors located outside of a refrigerated environment. Rather than pursue improvements in the hermetic sealing of electric motors (which would significantly increase their cost of procurement and operation) other efforts directed to ameliorating motor deterioration have been investigated.

Freezer equipment may be of the mechanically refrigerated and cryogenically cooled types, with the latter using a cryogenic medium such as carbon dioxide or liquid or gaseous nitrogen. The cryogenic media employed in commercial refrigeration systems typically has relatively low moisture content. After confirming that carbon dioxide and liquid and gaseous nitrogen coolants are compatible with direct contact with the interior components of an electric motor, attention was given to the effective employment of cryogen coolants to reduce the harmful effects of moisture intrusion into electric motors, especially those of the sealed type. It was found that pressurizing the interior of an electric motor with a dry cryogen coolant was not particularly effective in preventing the detrimental effects of moisture intrusion. Upon conducting tests, it was found that effective protection against moisture intrusion was associated with maintaining a constant minimum flow of dry cryogen coolant gas through an electric motor.

It is an object of the present invention to provide protection for electric motors against the harmful effects of moisture intrusion in refrigerated environments.

Another object according to principles of the present invention is to provide protection for electric motors against moisture intrusion, which is cost effective to install and operate.

These and other objects according to principles of the present invention, which will become apparent from studying the appended description and drawings, are provided in a cooling apparatus, comprising:

a source of coolant gas;

an enclosure having an interior;

gas release means for releasing gas within the enclosure to cool the enclosure interior;

an electric fan within the enclosure for circulating the environment within the enclosure;

the electric fan driven by an electric motor located within the enclosure interior, having an enclosing casing defining an interior volume, an electrical inlet communicating with the interior volume and an outlet also communicating with the interior volume;

gas conduit means coupling the source of coolant gas and the gas release means;

purge conduit means coupling the source of coolant gas and the electric motor to introduce flow of the coolant gas through the electric motor so as to exit the outlet of the electric motor.

DETAILED DESCRIPTION OF THE PREFERRED EMBODIMENTS

Figure 1:
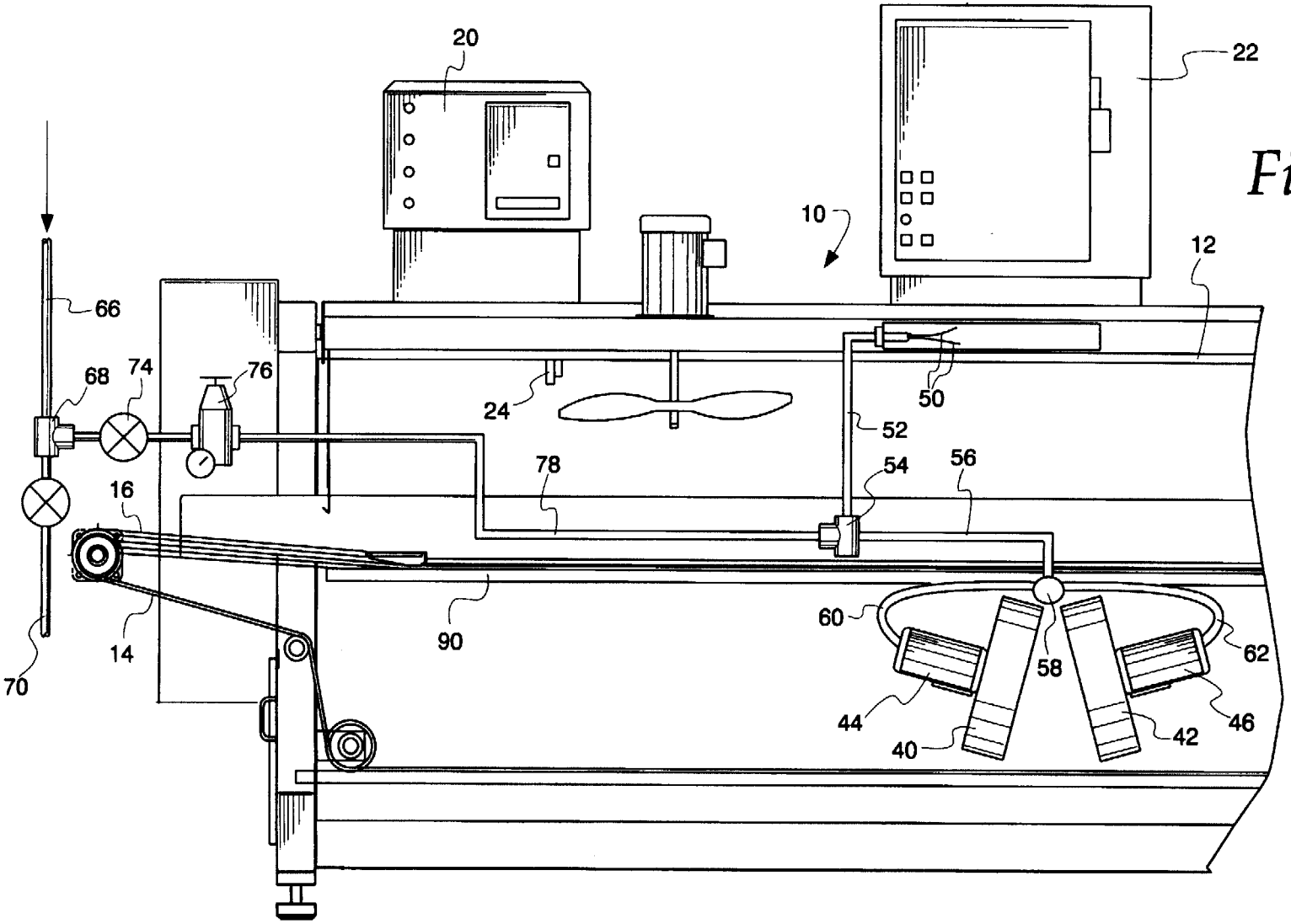
FIG. 1 is a fragmentary view of a freezer of according to principles of the present invention.

Referring now to the drawings, and initially to FIG. 1, a freezer is generally indicated at 10. The freezer 10 includes a tunnel enclosure 12, and a conveyor belt 14 which moves product through the freezer from an inlet end 16 to an outlet end 18 (see FIG. 2). Also included is a cryogen control cabinet 20 and an electrical control cabinet 22. The cryogen control cabinet directs cryogen coolant to gas release means or nozzles 24. In the preferred embodiment, the freezer 10 comprises an in-line tunnel freezer commercially available from the assignee of the present invention as Model No. JE-U4. Preferably, the cryogen employed is $CO_2$, although other cryogen coolants such as liquid nitrogen can also be used.

Figure 2:
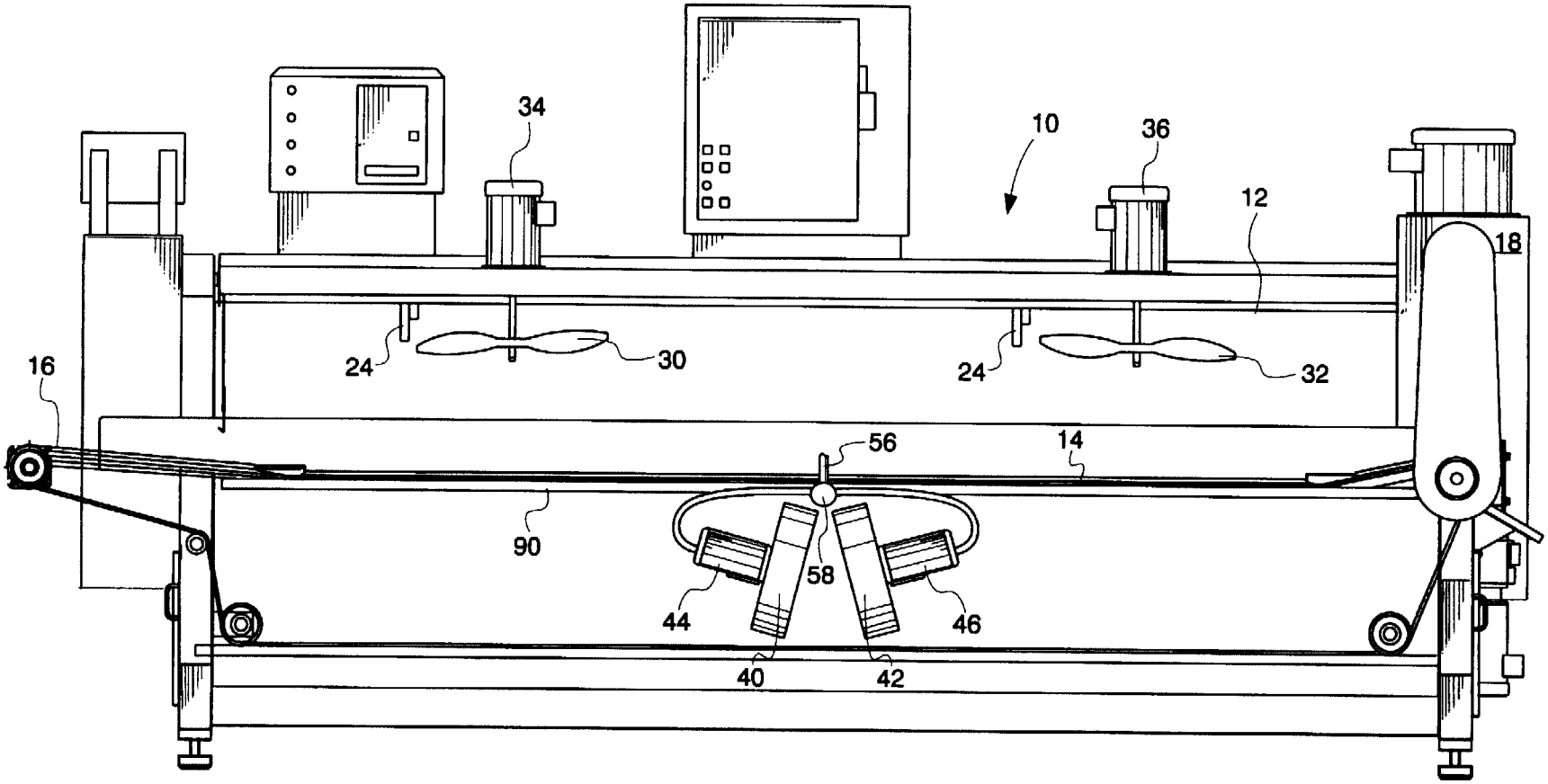
FIG. 2 is an elevational view of the freezer apparatus of FIG. 1.
Figure 4:
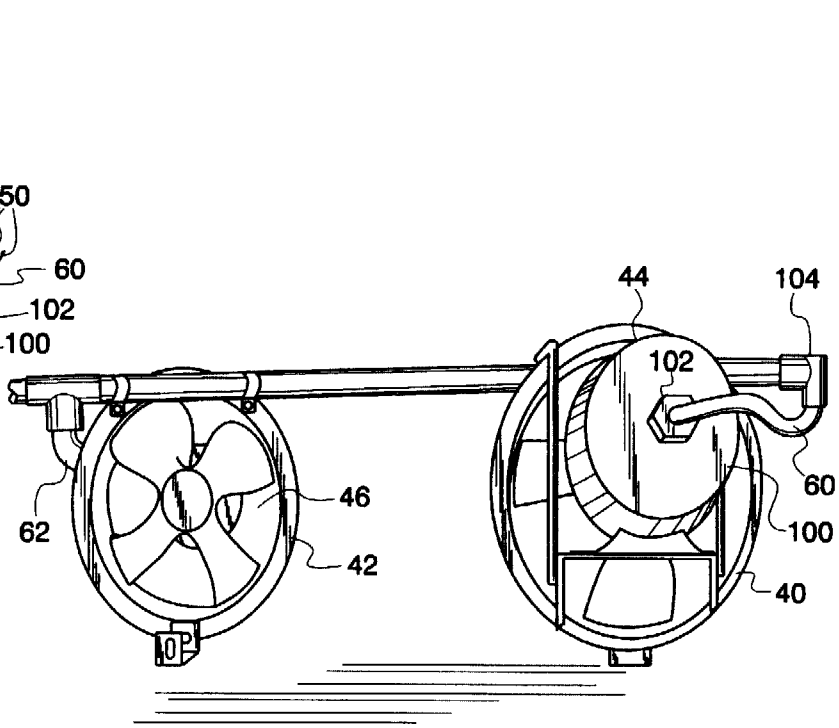
FIGS. 3 and 4 are fragmentary perspective views of fans driven by electric motors located within the freezer illustrated in FIGS. 1 and 2.
Figure 3:
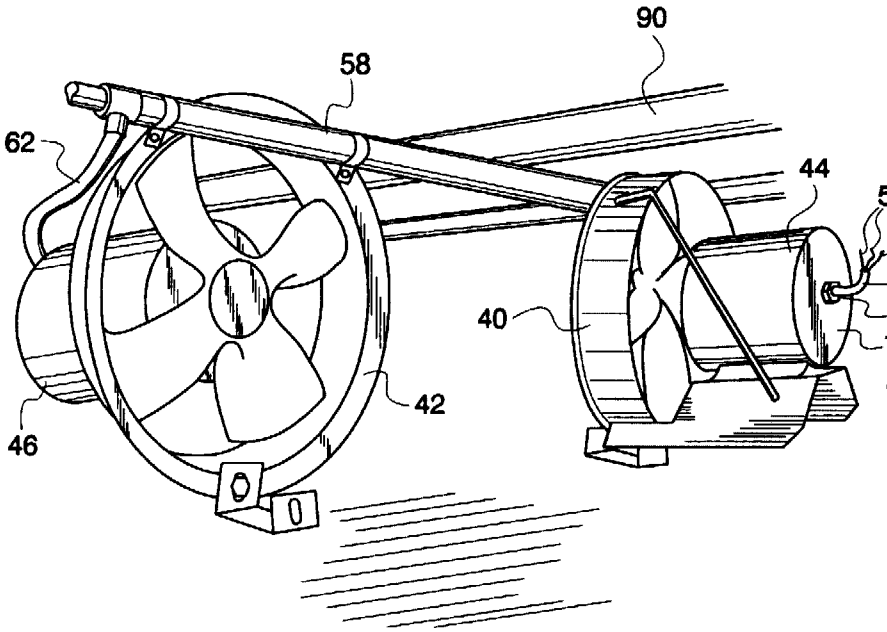

As can be seen in FIGS. 1 and 2, the freezer 10 includes a pair of overhead fans 30, 32 driven by electric motors 34, 36 located outside of enclosure 12, atop the enclosure roof. Blowers 40, 42 driven by electric motors 44, 46 are located between the upper and lower runs of conveyor belt 14. The blowers 40, 42 are oriented in a generally horizontal direction, being tilted at a slight downward angle. FIGS. 3 and 4 show the blowers 40, 42 from a vantage point looking generally toward exit end 18 of the freezer, from a point at the left hand end of FIG. 2. As can be seen in FIGS. 3 and 4, the blowers 40, 42 are laterally offset from one another so as to avoid interference with the circulation within enclosure 12.

Referring again to FIGS. 1 and 2, the motors 44, 46 receive electrical power from control cabinet 22 through electrical conductors 50 enclosed within a first conduit run 52, a junction box 54, a rigid conduit 56 and flexible conduit lines 60, 62. Cryogen coolant enters the system through a line 66 from a supply tank (not shown). The cryogen coolant is split up at junction 68 into two flow paths. The first flow path passes through line 70 to the nozzles 24. The cryogen coolant also travels along a second path through a valve 74 and regulator 76, passing along line 78 to junction box 54. Preferably, cryogen coolant traveling through line 78 is in a gaseous form, although it could also be in a liquid or mixed phase form, if desired.

A pressure block or seal is provided at the junction of conduit 52 and junction box 54 to prevent cryogen coolant from entering the electrical control cabinet 22. The cryogen coolant is, however, allowed to pass through junction box 54 to pressurize conduits 56 and flexible lines 60, 62, entering into motors 44, 46. The cryogen coolant system upstream of junction box 54 is shown outside of cryogen control cabinet 20 for clarity of illustration, although most of this equipment is located within the cryogen control cabinet.

Preferably, the conduit 56 is located at a back wall of freezer 10 (located in the background of FIGS. 1 and 2). Conduit 56 includes a horizontal run portion 58 visible in FIGS. 3 and 4, which travels in a direction generally perpendicular to the direction of travel of conveyor belt 14. Referring briefly to FIG. 1, the upper run of conveyor belt 14 is borne by below by support members 90. As seen in FIGS. 3 and 4, the conveyor run 58 is supported from support members 90 and provides a convenient mounting for blowers 40, 42. Preferably, the conduit 58 is relatively rigid compared to the flexible lines 60, 62. The junction box 54, conduit lines 56, 58 and flexible lines 60, 62 are preferably of pressure-tight construction so as to contain the pressure of cryogen coolant controlled by regulator 76 and so as to sustain a controlled flow of cryogen coolant through the motors 44, 46.

Figure 5:
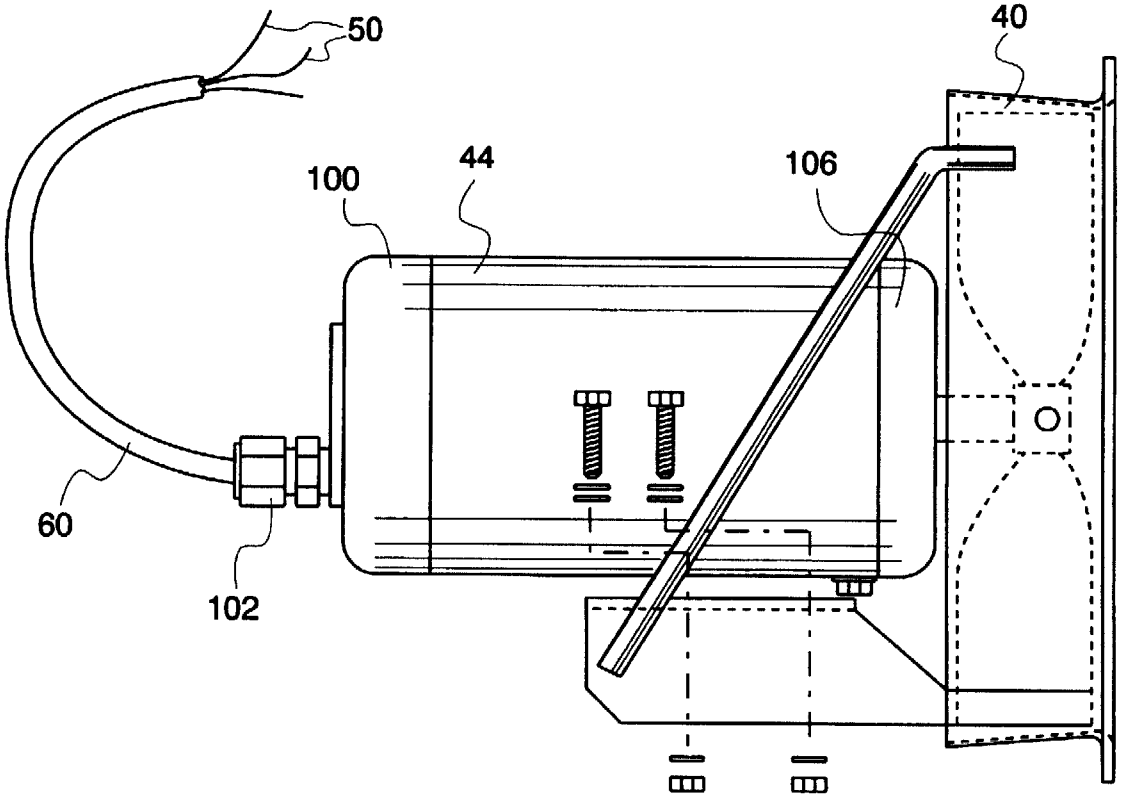
FIG. 5 is a side elevational view of a motor of the preceding Figures, shown on an enlarged scale.
Figure 6:
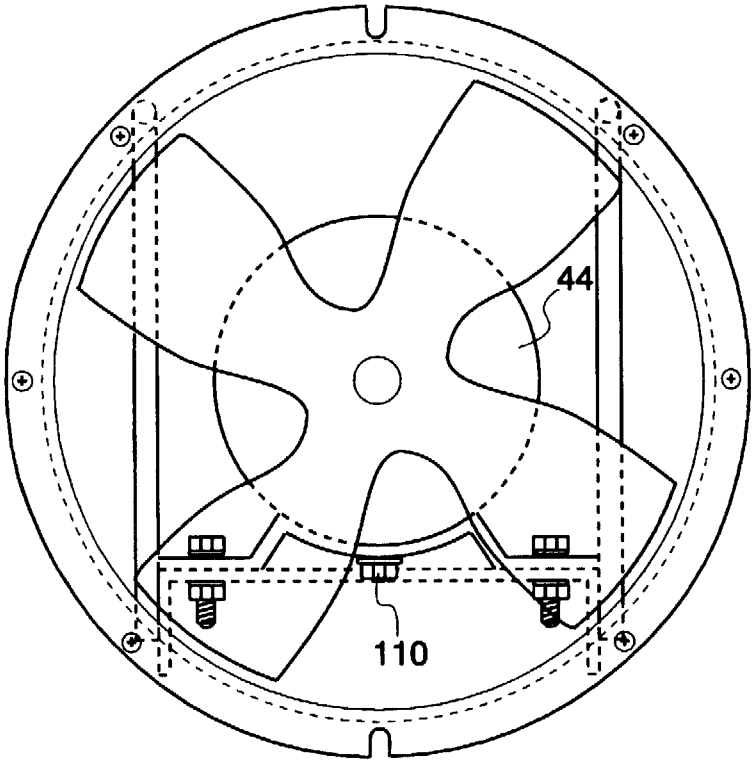
FIG. 6 is an end view thereof.

Referring to FIG. 5, blower 40 and motor 44 (which drives the fan blades of the blower) is shown on an enlarged scale. Preferably, motor 44 is an electric motor of the closed frame or sealed type. In the preferred embodiment, electric motor 44 is commercially available from Baldor Electric Company as a special horizontal motor of type TENV, Model 33M-NEMA 42Z. Ring type seals are provided on the motor shaft, and neoprene gaskets are used in the construction of the motor frame to prevent moisture intrusion into the motor interior.

FIG. 5 also shows electrical conductors 50 located in flexible line 60. The flexible line 60 is mounted to a back wall 100 of motor 44 by a coupling 102. As shown in FIG. 4, flexible line 60 is connected through a junction 104. In the preferred embodiment, the motor 44 has a generally cylindrical frame with a front wall 106 located opposite the aforementioned back wall 100. In the preferred embodiment, back and front walls 100, 106 preferably comprise end bells typical of conventional electrical motor constructions. As mentioned above, cryogen coolant pressurizes conduit line 58 and flexible line 60. The cryogen coolant is allowed to pressurize the interior of motor 44, and this alone may be sufficient in some installations to adequately protect the electric motor.

Figure 7:
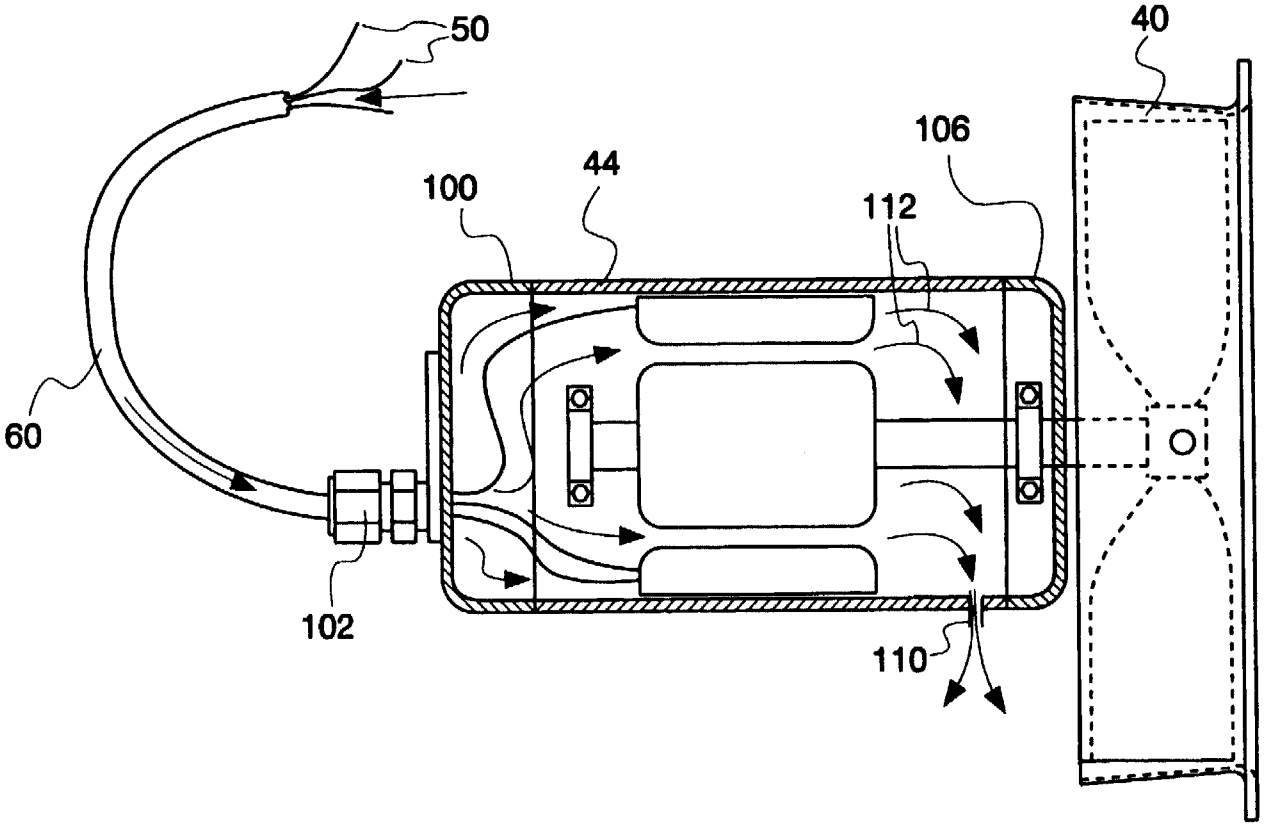
FIG. 7 is a cross-sectional view similar to that of FIG. 5 showing the motor interior.

As indicated in FIG. 7, by arrows 112, cryogen coolant flows through motor 44, between the internal components of the motor (both electrical components such as field windings and mechanical components such as bearings) so as to exit through plug 110. By way of experimentation using the above-mentioned commercial freezer Model JE-U4, the plugs 110 were sealed and, after two weeks of regular operation, substantial condensation was found in the motor interiors, even though $CO_2$ vapor pressure had been maintained continuously during the test period. It was found necessary to maintain a minimum flow of cryogen coolant through the electric motors in order to prevent moisture accumulation through the motor interior. Accordingly, a plug 110 having a controlled orifice size is installed in front wall 100. In the preferred embodiment, plugs 110 are those commercially available from the motor manufacturer as T-drain plug Part No. SP-5435. Initial tests performed on the Model JE-U4 freezer indicate that a flow rate of approximately 10 standard cubic feet per hour for each blower is adequate to prevent moisture-related premature failure of the blower motors. As will be appreciated by those skilled in the art, the freezer shown in FIG. 2 is of a modular construction type, and if longer residence time is needed to refrigerate products of a particular type, additional freezer enclosures may be added back-to-back, in a serial array to form a continuous freezer production line. Tests were conducted with the number of blowers ranging between 2 and 8 and the required increase in flow rate from regulator 76 was found to be linear, with 80 standard cubic feet per hour being required to supply purge flow for 8 blowers. The blowers tested were of the fractional horsepower size, and were operated at 240 volts a.c. The required cryogen flow rate through the motor may differ for other installations. In the test, the regulator 76 was employed to limit the vapor line pressure in conduit 78 from between 3 and 6 psi. A $CO_2$ vapor flow meter was inserted downstream of the regulator 76 to measure flow to the blower motors.

Figure 8:
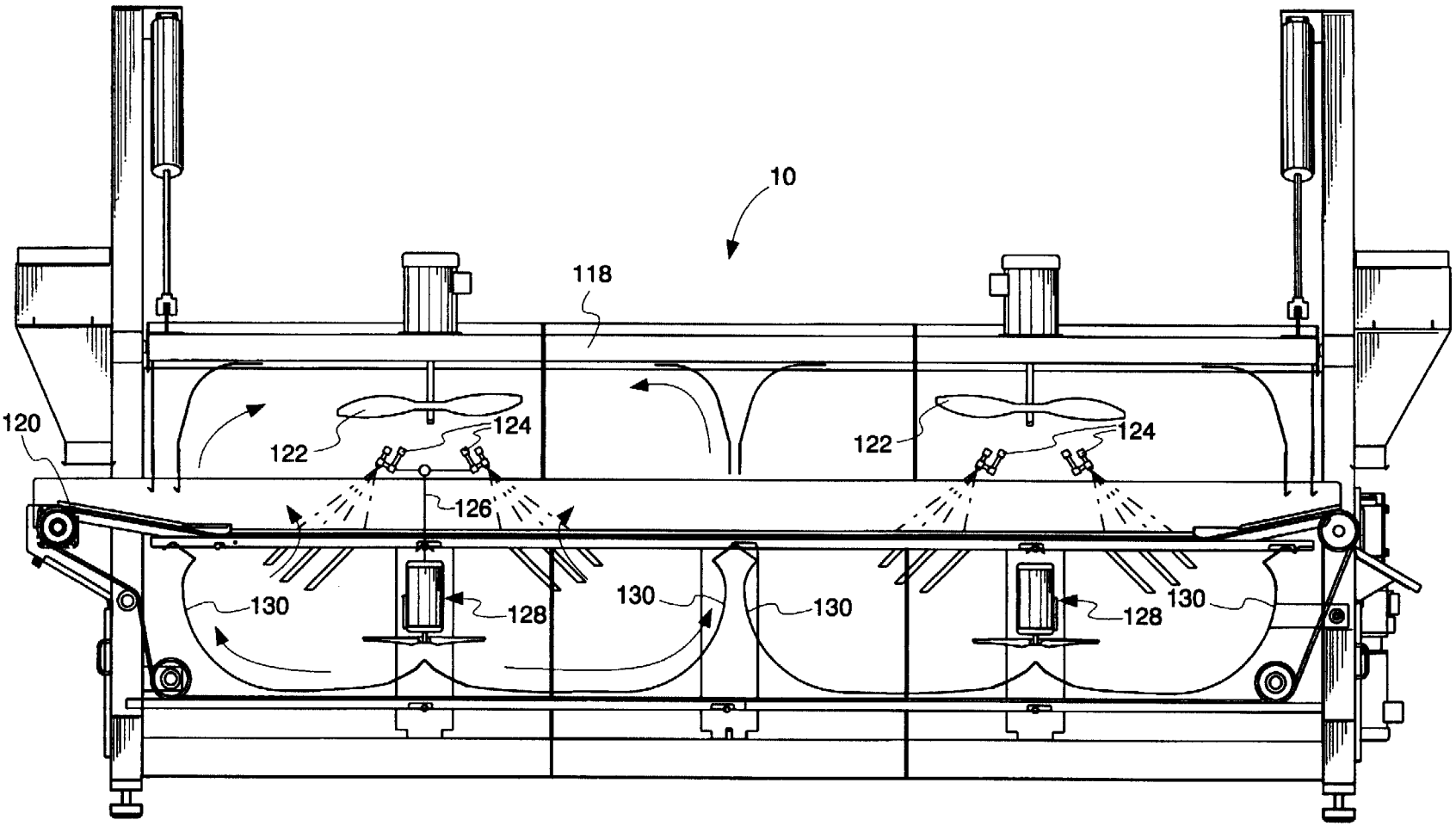
FIG. 8 is a fragmentary elevational view, shown in cross section, of another example of a freezer constructed according to principles of the present invention.

FIGS. 8–12 show various alternative freezer configurations to which the cryogen purge flow system may be adapted to protect electric motors located within refrigerated environments. In FIG. 8, a tunnel freezer 116 is shown. The freezer is described in U.S. patent application Ser. No. 08/245,531, filed May 13, 1994, and assigned to the assignee of the present invention. The disclosure of this patent application is incorporated as if set forth fully herein. The freezer 116 in FIG. 8 includes a tunnel enclosure 118 and a conveyor belt 120 formed in an endless loop, for transporting products through the freezer interior. Overhead fans 122 circulate $CO_2$ cryogen coolant, preferably in the form of finely divided particles or "snow" form exiting injectors 124. Injectors 124 are fed by cryogen supply lines 126 which also extend to the rear walls of electric motors 128 disposed below the upper run of conveyor belt 120. Motors 128 drive fan blades with a generally downwardly directed discharge, circulating the $CO_2$ snow and freezer atmosphere across deflection plates 130 located in the floor of the freezer. The motors 128 are preferably provided with an exit orifice adjacent the front wall of the motors to allow cryogen coolant flow through the motor interior in the manner described above.

Figure 9:
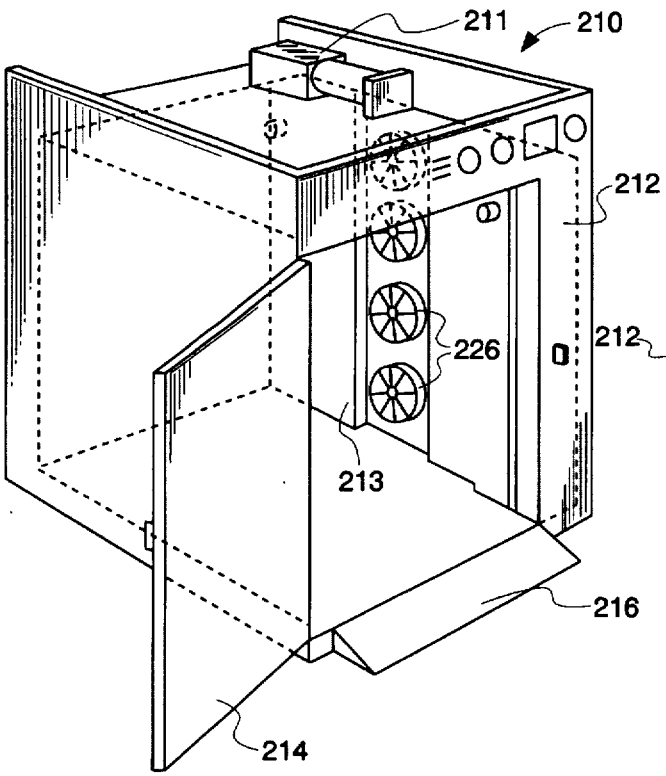
FIG. 9 is a fragmentary perspective view of a further embodiment of freezer apparatus according to principles of the present invention.
Figure 10:
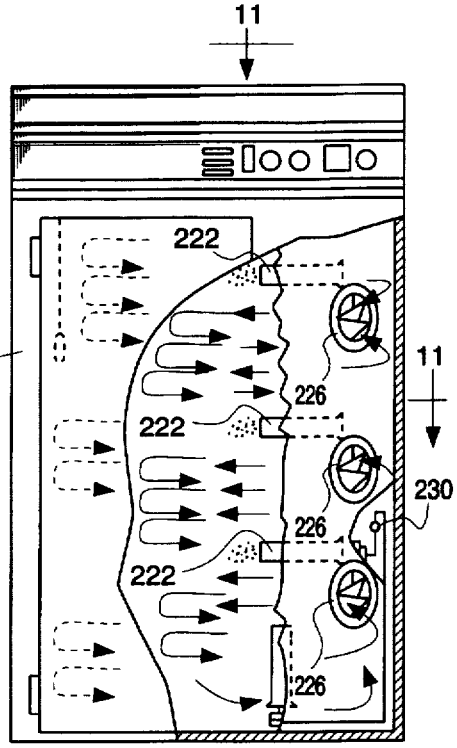
FIG. 10 is a front elevational view thereof.
Figure 11:
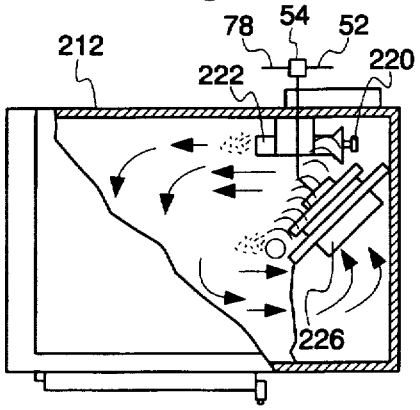
FIG. 11 is a fragmentary cross-sectional view taken along the line 11—11 of FIG. 10.

FIGS. 9–11 show cabinet freezers of the type described in commonly assigned U.S. Pat. No. 4,344,291, the disclosure of which is incorporated as if fully set forth herein. The freezer 210 shown in FIG. 9 is provided with both cryogen and mechanical types of refrigeration equipment. The mechanical refrigeration equipment 211 is mounted atop the roof of cabinet enclosure 212. Cryogen refrigeration equipment is located behind sidewall 213 of the cabinet enclosure. Blowers 226, driven by electric motors, are also located in sidewall 213 and are coupled to the cryogen supply lines in the manner described above so as to set up a flow of cryogen coolant through the electric motor housing to prevent moisture accumulation within the motors. If desired, the mechanical refrigeration 211 could be relied upon the cool the interior of cabinet 212, with the cryogen coolant being supplied solely to the electric motors, if desired. However, it is generally desired that the mechanical refrigeration equipment 211 be supplemented by cryogen cooling of the cabinet enclosure.

FIG. 10 shows an arrangement similar to FIG. 9 except for the presence of three blowers 226 and the omission of mechanical refrigeration equipment 211.

Figure 12:
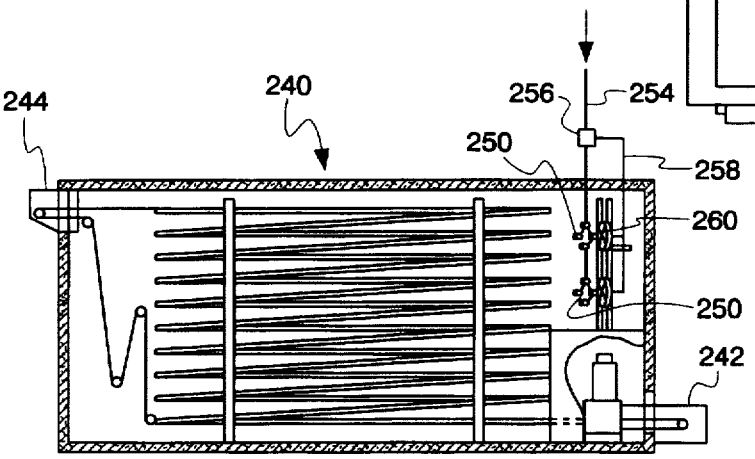
FIG. 12 is a fragmentary elevational view, shown in cross section, of another alternative freezer arrangement.

FIG. 12 is a cross-sectional view of a freezer having a spiral conveyor belt generally shown and described in U.S. Pat. No. 4,356,707, assigned to the assignee of the present invention. U.S. Pat. No. 4,356,707 is incorporated as if fully set forth herein. The freezer generally indicated at 240 in FIG. 12 has a helical or so-called "spiral" conveyor belt having an inlet end 242 and an exit end 244. As shown in FIG. 12, the conveyor belt is of endless form, and returns from the top of freezer 240 over a series of tension-controlling rollers to the inlet end 242. The conveyor belt then travels to the left in FIG. 12 upwardly along the spiral path shown. $CO_2$ cryogen injection units 250 receive cryogen flow from line 254. The cryogen flow is split at junction box 256 so as to flow through lines 258 which are terminated at blower motors 260. A cryogen flow is maintained through the electric motors 260 in the manner described above, so as to prevent moisture intrusion within the motors.

Referring now to FIGS. 9–11, a cryogenic cabinet freezer is generally indicated at 210. The freezer 210 includes an insulated cabinet 212 having a door 214 allowing access to the cabinet interior. Typically, carts loaded with food products to be refrigerated are wheeled over ramp 216, through the opening formed by open door 214. Referring to FIG. 11, injection nozzle 220 and inducer 222 inject cryogen coolant into the interior of cabinet 212. Blowers 226 circulate freezer atmosphere within cabinet 212. The blowers 226 are driven by electric motors (not shown) which are disposed within the cryogenic environment. As indicated by the arrows in FIGS. 10 and 11, circulation patterns are set up within cabinet 212, which bring moisture from products being cooled into contact with the blowers, and the electric motors associated therewith. Preferably, the cryogen media employed is liquid $CO_2$ which exits the inducers 222 in the form of finely divided snow particles. The cryogen is supplied through piping 30 (see FIG. 10) to the inducers 222.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. Cooling apparatus, comprising:

a source of coolant gas;

an enclosure having an interior;

gas release means for releasing gas within the enclosure to cool the enclosure interior;

an electric fan within the enclosure for circulating the environment within the enclosure;

the electric fan driven by an electric motor located within the enclosure interior, having an enclosing casing defining an interior volume, an electrical inlet communicating with the interior volume and an outlet also communicating with the interior volume;

gas conduit means coupling the source of coolant gas and the gas release means;

purge conduit means coupling the source of coolant gas and the electric motor to introduce flow of the coolant gas through the electric motor so as to exit the outlet of the electric motor.

2. The apparatus of claim 1 wherein the electrical inlet comprises an aperture defined by said casing for passage of electrical conductors through the casing, and the purge conduit means is coupled to the electrical inlet.

3. The apparatus of claim 2 wherein the purge conduit means comprises a flexible conduit carrying both electrical conductors and coolant gas to the interior of the casing.

4. The apparatus of claim 3 wherein the casing includes a cylindrical body having opposed front and rear walls, with the electrical inlet located at the rear wall, and the outlet located adjacent the front wall, with coolant gas flowing parallel to the central axis of the casing.

5. The apparatus of claim 1 further comprising flow control means coupled to the purge conduit means to maintain a predetermined minimum flow rate of coolant gas through the casing.

6. The apparatus of claim 1 wherein the outlet comprises a threaded plug defining an exit passageway and threadingly engaged with the casing.

7. Cooling apparatus, comprising:

a source of coolant gas;

an enclosure having an interior;

gas release means for releasing gas within the enclosure to cool the enclosure interior;

an electric fan within the enclosure for circulating the environment within the enclosure;

the electric fan driven by an electric motor located within the enclosure interior, having an enclosing casing defining an interior volume, an electrical inlet communicating with the interior volume and an outlet also communicating with the interior volume;

a source of electric power;

coolant conduit means coupling the source of coolant gas and the gas release means; and motor conduit means coupling the source of coolant gas and the electric motor, the motor conduit means also carrying electrical conductors coupled to the source of electric power, in addition to a flow of coolant gas.

8. The apparatus of claim 7 further comprising joining means joining the motor conduit means and the coolant conduit means.

9. The apparatus of claim 8 wherein the electrical inlet comprises an aperture defined by said casing for passage of electrical conductors through the casing, and the purge conduit means is coupled to the electrical inlet.

10. The apparatus of claim 9 wherein the purge conduit means comprises a flexible conduit carrying both electrical conductors and coolant gas to the interior of the casing.

11. The apparatus of claim 10 wherein the casing includes a cylindrical body having opposed front and rear walls, with the electrical inlet located at the rear wall, and the outlet located adjacent the front wall, with coolant gas flowing parallel to the central axis of the casing.

12. The apparatus of claim 9 further comprising flow control means coupled to the purge conduit means to maintain a predetermined minimum flow rate of coolant gas through the casing.

13. The apparatus of claim 12 wherein the outlet comprises a threaded plug defining an exit passageway and threadingly engaged with the casing.

14. A freezer apparatus, comprising:

a source of cryogen gas;

a freezer enclosure having an interior;

gas release means for releasing the cryogen gas within the freezer enclosure to cool the enclosure interior;

a conveyor belt within the freezer enclosure to transport product to be cooled;

an electric fan within the enclosure for circulating the freezer environment across the conveyor belt;

the electric fan driven by an electric motor located within the enclosure interior, having an enclosing casing defining an interior volume, an electrical inlet communicating with the interior volume and an outlet also communicating with the interior volume;

electric conduit means coupling the electric motor to a source of electric power;

gas conduit means coupling the source of coolant gas and the gas release means;

joining means joining the electric conduit means and the gas conduit means to introduce flow of the coolant gas through the electric motor, into the electrical inlet and out the outlet.

15. The apparatus of claim 14 wherein the electric fan is located immediately under the conveyor belt.

16. The apparatus of claim 15 further comprising joining means joining the motor conduit means and the coolant conduit means.

17. The apparatus of claim 14 wherein the electrical inlet comprises an aperture defined by said casing for passage of electrical conductors through the casing, and the purge conduit means is coupled to the electrical inlet.

18. The apparatus of claim 17 wherein the purge conduit means comprises a flexible conduit carrying both electrical conductors and coolant gas to the interior of the casing.

19. The apparatus of claim 18 further comprising flow control means coupled to the purge conduit means to maintain a predetermined minimum flow rate of coolant gas through the casing.

20. The apparatus of claim 19 wherein the outlet comprises a threaded plug defining an exit passageway and threadingly engaged with the casing.

21. A method for cooling products, comprising the steps of:

providing a source of coolant gas;

providing an enclosure having an interior;

providing gas release means for releasing gas within the enclosure to cool the enclosure interior;

coupling the source of coolant gas to the gas release means;

circulating the environment within the enclosure with an electric fan having an electric motor located within the enclosure;

providing the electric motor with an enclosing casing defining an interior volume;

coupling the source of coolant gas to the electric motor and flowing coolant gas through the electric motor.

* * * * *